United States Patent [19]

Fukushi et al.

[11] Patent Number: 4,624,546

[45] Date of Patent: Nov. 25, 1986

[54] IMAGE FORMING APPARATUS WITH A SORTER

[75] Inventors: Yukihiro Fukushi, Kawasaki; Hiroyuki Segawa, Tokyo, both of Japan

[73] Assignee: Kabushiki Kaisha Toshiba, Kanagawa, Japan

[21] Appl. No.: 737,939

[22] Filed: May 28, 1985

[30] Foreign Application Priority Data

May 30, 1984 [JP] Japan ..... 59-110214

[51] Int. Cl.[4] ..... G03G 15/00

[52] U.S. Cl. ..... 355/14 R; 355/14 SH; 355/3 SH; 271/296

[58] Field of Search ..... 355/14 R, 3 SH, 14 SH; 271/296, 288

[56] References Cited

U.S. PATENT DOCUMENTS

| | | | |
|---|---|---|---|
| 4,403,851 | 9/1983 | Yanagawa | 355/14 R |
| 4,405,225 | 9/1983 | Perrault | 355/14 R |
| 4,452,525 | 6/1984 | Ogura | 355/3 SH X |
| 4,515,458 | 5/1985 | Masuda et al. | 355/3 SH |

*Primary Examiner*—A. C. Prescott

*Attorney, Agent, or Firm*—Schwartz, Jeffery, Schwaab, Mack, Blumenthal & Evans

[57] ABSTRACT

A copying or printing machine comprising a microcomputer, a memory having a sequence control program for accomplishing copying or printing operation, and a processing unit operative for reproducing a copy. The copying machine is provided with a delivering device for delivering the copy, a sorter for sorting successive copies delivered from the delivering device and a jam detector for detecting a jamming of a copy in the sorter. The delivering device is covered with a cover which may be opened so that an operator may access the delivery device.

When a malfunction in the sorter is detected by the jam detector, the microcomputer stops the operation of the copying machine. It is necesary for the operator to remove the copy detected by the jam detector and to close the cover after opening it once for restarting the operation of the copying machine. The microcomputer enables the copying machine to restart after it detects that the copy detected by the jam detector is cleared and the cover is closed.

7 Claims, 10 Drawing Figures

IMAGE FORMING APPARATUS WITH A SORTER

BACKGROUND OF THE INVENTION

This invention relates to an image forming apparatus including a copying machine or printer having a sorter or collating means which accumulates copy sheets in bins.

Copying machines are provided with a sorter which is mounted on a discharge port of the copying machine. The copy sheets, copied in the copying machine, are collected in the sorter bins in order of discharge from the discharge port. The copying machine is provided with a jam detecting device. The jam detecting device causes the copying machine to assume a jamming status in which the copying operation is interrupted in response to the detection of jamming. The copy sheet clogging the copying machine must be removed in order to release jamming status.

When the copy sheet clogs the sorter during a multi-copy run and the clogged copy sheet is detected by the jam detecting device, however, copy sheets may also remain in the copying machine. Therefore, jamming may recur due to the copy sheets remaining in the copying machine, even though the clogged copy sheet in the sorter has been removed to release the jamming status and restart the copying operation. Further, the jam detecting device is located at a position where jamming is apt to occur, such as a copy sheet feeding station and a copy sheet discharging station. For this reason, when the copy sheet is clogged at a position where the jam detecting device is not located, the jamming may not be detected immediately. Therefore, jamming may occur again at restarting the copying machine even if the only copy sheet detected by the jam detecting device is removed to release the jamming status.

SUMMARY OF THE INVENTION

Accordingly, it is an object of the present invention to provide an image forming apparatus with a sorter, in which jamming may be prevented after releasing a jamming status.

Another object of the present invention is to provide an image forming apparatus with a sorter, in which restarting of an image forming operation may be permitted only if an inspection of the apparatus has been made.

These and other objects are achieved by providing a novel image forming apparatus including means for forming an image on a copy sheet, means for delivering the copy sheet carrying the image formed by the image forming means, means for collating the copy sheet delivered by the delivering means, means for covering the delivering means, the covering means being adapted to open so as to provide access to the delivering means to remove the copy sheet, first detecting means for detecting the opening of the covering means, second detecting means for detecting a jamming of the copy sheet in the collating means, first control means for stopping the image forming operation of the image forming means in response to the detection of the second detecting means, and second control means for permitting the restarting of the image forming operation in response to the detection of the first detecting means only if the second detecting means detects that the jamming of the copy sheet in the collating means has been cleared.

BRIEF DESCRIPTION OF THE DRAWINGS

A more complete appreciation of the invention will be readily obtained by reference to the following detailed description when considered in connection with the accompanying drawings, wherein:

FIG. 2(*b*) is a front view of a cam system of the sorter;

DETAILED DESCRIPTION OF THE PREFERRED EMBODIMENTS

Figure 1:
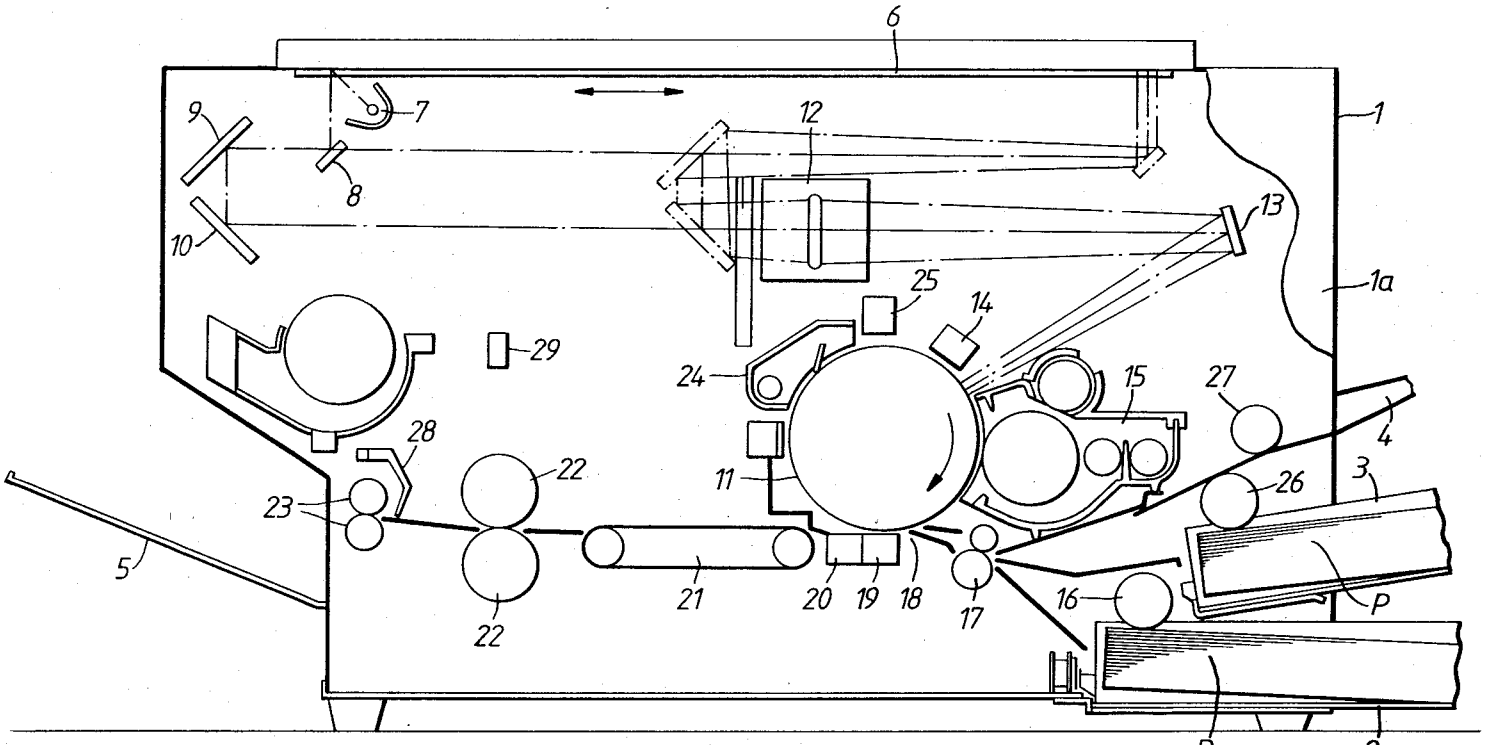
FIG. 1 is a front view of the inside of a copying machine incorporating the present invention.

Referring now to FIG. 1, a copying machine is shown schematically as an embodiment of an image forming apparatus according to the present invention. This copying machine utilizes electrophotography.

On one side of a casing 1 of the copying machine, a lower cassette 2 and an upper cassette 3 where copy sheets P are stored are mountably provided. Above upper cassette 3, a bypass feeding table 4 for supplying copy sheets P manually is provided. On the other side of casing 1, a tray 5 is provided. This tray 5 may be removed.

An original platen 6 having a transparent glass plate for supporting an original document on the surface thereof, is provided on an upper surface of casing 1. Below platen 6, an exposure lamp 7 and mirrors 8, 9 and 10 are provided. These elements define an optical system. The optical system is reciprocated along the original, synchronously with a drum 11 provided with a photosensitive layer on the surface thereof. This drum 11 is rotated in the direction of the arrow in FIG. 1. By the scanning operation of the optical system of the original document supported on platen 6, the optical image of the original is projected by mirrors 8, 9 and 10, a lens 12 and a mirror 13, and an electrostatic latent image is formed on the surface of drum 11. The surface of drum 11 is charged previously by a corona charger 14. The electrostatic latent image is visualized by depositing toner particles at a developing device 15.

Copy sheets P in lower cassette 2 are taken out one-by-one by a lower feed roller 16 and are then guided by register rollers 17 to a transferring station 18 located between a transfer charger 19 and drum 11. Accordingly, as drum 11 is rotated, the toner image carried on drum 11 is transferred to copy sheet P fed from register rollers 17 at transferring station 18, so that the toner image is transferred to copy sheet P by transfer charger 19. After the toner image is transferred, copy sheet P is separated by a separation charger 20 from the surface of drum 11. After that, copy sheet P is transported by a conveyer belt 21 to a fixing device 22. The transferred toner image is fixed on copy sheet P by the fixing device. Fixed copy sheet P is discharged outside casing 1 by discharge rollers 23 to be accumulated on tray 5. After transfer, residual toner on the surface of drum 11 is removed by a cleaner 24. Also, any residual electrostatic image is discharged by an erase lamp 25, so that the copying machine returns to an initial state to form images repeatedly.

When upper cassette 3 is selected, copy sheets P are taken out one-by-one from cassette 3 by an upper feeding roller 26. Also, copy sheet P supplied from table 4 is fed by a bypass feed roller 27 to register rollers 17. Copy sheet P thus fed from upper cassette 3 or bypass feeding table 4 is guided to transferring station 18 by register rollers 17.

A detecting switch 28 is positioned at the front side of discharge rollers 23 to detect copy sheet P which is discharged from casing 1.

There is also provided a front door or covering means 1*a* (shown partially cut away) which covers the front side of the copying machine. The front door may be opened and closed to gain access to the inside of the copying machine in case of malfunction. A door switch 29 is provided in casing 1. This switch 29 detects if the front door is opened or closed according to its actuation by the front door.

Figure 2A:
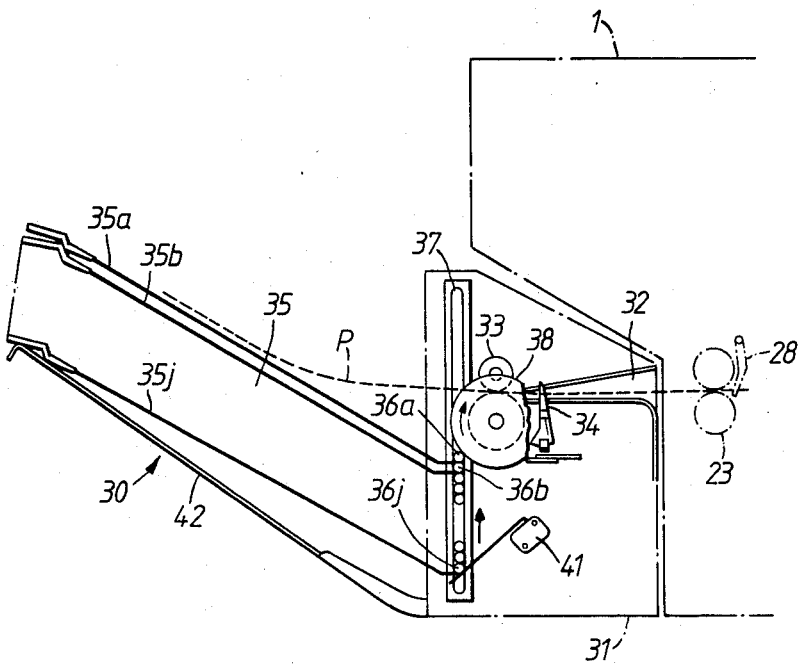
FIG. 2(*a*) is a front view of the inside of a sorter mounted on the copying machine.
Figure 2B:
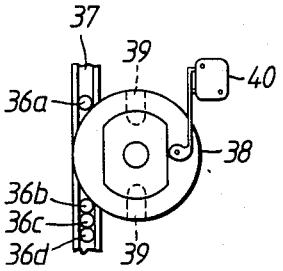

Referring to FIGS. 2(*a*) and (*b*), a sorter or collating means 30 is mounted instead of tray 5 on casing 1, tray 5 having been removed. Therefore, copy sheet P, discharged by discharge roller 23, is transported along a transportation passage 32 provided on one side of a casing 31 of sorter 30. A paper detection switch 34 is located at a position in transportation passage 32. This switch 34 detects copy sheet P discharged by discharge roller 23 and actuates roller 33 for conveying copy sheet P in response to the detection. By the operation of roller 33, copy sheet P is transported through passage 32, and is fed into a bin station 35. This bin station 35 includes 10 bins 35*a*–35*j*. These bins 35*a*–35*j* are vertically separated, so that copy sheets P are accommodated on the surface of each bin. The left ends of bins 35*a*–35*j* are free ends, and the other ends are supported respectively by rollers 36*a*–36*j*, one-by-one. Rollers 36*a*–36*j* are fixed rotatably on the supported ends of bins 35*a*–35*j*, and are received slidably in a groove 37 of casing 31. Bins 35*a*–35*j* are energized upwardly by a spring (not shown). A bin driving cam 38 is located adjacent with rollers 36*a*–36*j*. Roller 36*j* at the lowest position is always energized by the spring in the direction of the vertical arrow in FIG. 2(*a*), thereby, roller 36*a* at the uppermost position is urged to press the outer periphery surface of cam 38.

By the rotation of cam 38, each of rollers 36*a*–36*j* may be engaged with recesses 39 formed on the outer periphery surface of cam 38. With each half turn of cam 38, rollers 36*a*–36*j* are moved upwardly or downwardly one-by-one. Thus bins 35*a*–35*j* are also moved vertically. A cam position switch 40 is provided on casing 31. This switch 40 detects the position of bin driving cam 38. A home position switch 41 is also provided. This switch 41 detects if bin station 35 is positioned at a home position where bin station 35 is placed at the lowest position shown in FIG. 2(*a*). The free end of bin 35*j* is placed on a support member 42 which is fixed to casing 31 of sorter 30.

In this embodiment, sorter 30 has three operation modes:

(1) A non-sort mode where sorter 30 is used in the same manner as tray 5;

(2) A sort mode where bins 35*a*–35*j* are slid respectively to receive a set of copies in the sequence of the original pages; and (3) A group mode where bins 35*a*–35*j* are slid respectively to receive a plurality of copies corresponding respectively to every page of the original.

These modes are designated by operating mode switches (not shown).

In the non-sort mode, all of copy sheets P are stored in bin 35*a* and bins 37*a*–37*j* are not moved into position to receive copy sheets.

In the sort mode, cam 38 is rotated in the direction of the curved arrow in FIG. 2(*a*), so that bin 35*a* is driven upwardly to receive copy sheets P, and then displaced upward after copy sheets P have been stored therein. Bins 35*a*–35*j* are moved one-by-one for receiving copy sheets P until the final copy sheet is stored.

In the group mode, one or more copies are reproduced from one original, and the copies are stored in bins 35*a*–35*j*.

When the operation mode of sorter 30 is changed or initialized, cam 38 is rotated until switch 41 is actuated by bin 35*j*. As a result, bin station 35 is placed at the home position.

Figure 3:
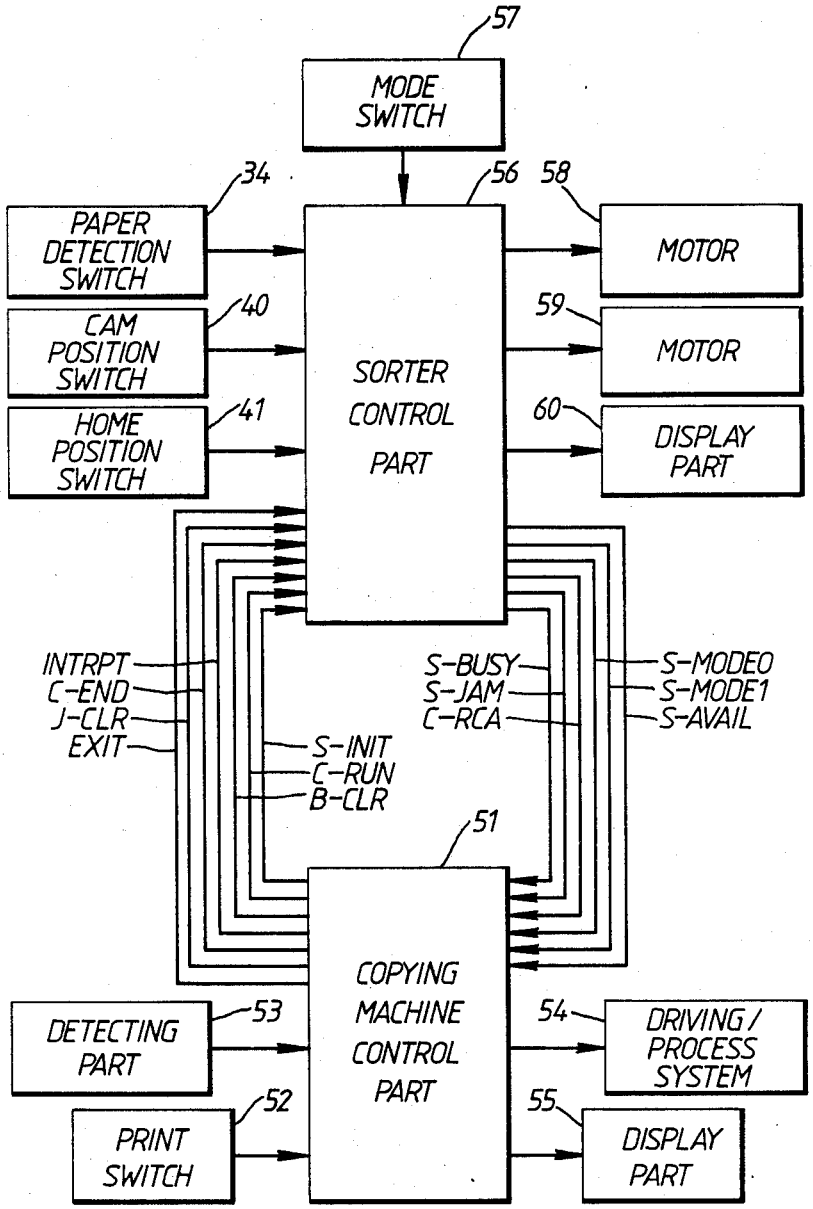
FIG. 3 is a block diagram showing a control device for controlling the operation of the copying machine and the sorter.

Referring to FIG. 3, explanation will be given regarding a control device for controlling the operation of the machine.

First, a copying machine controller 51 receives signals from a print switch 52 and a detecting part 53 including switches 28 and 29, and controls both a driving/process system 54 for driving the image forming elements, and a display part 55. Controller 51 is mainly constituted of a microcomputer and peripheral devices, and is operated to perform various operations according to a sequence control program which is previously stored in a read only memory (ROM) for controlling the machine. The microcomputer also has a built-in memory (RAM) for storing data and utilizes a timer. Display part 55 illustrates various operational conditions and includes a liquid crystal display panel.

Next, a sorter controller 56 receives signals from detecting switches 34, 40 and 41 and a mode switch 57 for designating the operation mode of sorter 30, and controls motors 58 and 59 and a display part 60. Sorter controller 56 is also constituted of a microcomputer and peripheral devices, and is operated to execute various operations according to a control program previously stored in a ROM. Motor 58 is used for rotating transportation roller 33, and motor 59 is used for rotating cam 38. Sorter controller 56 actuates motor 58 so as to rotate roller 33 when the leading edge of a copy sheet P is detected by detecting switch 34. After the trailing edge of copy sheet P passes over the position of switch 34, sorter controller 56 stops motor 58 so as to stop the rotation of roller 33.

Display part 60 indicates operational conditions and jamming, and is provided on the operational panel of sorter 30.

Figure 4:
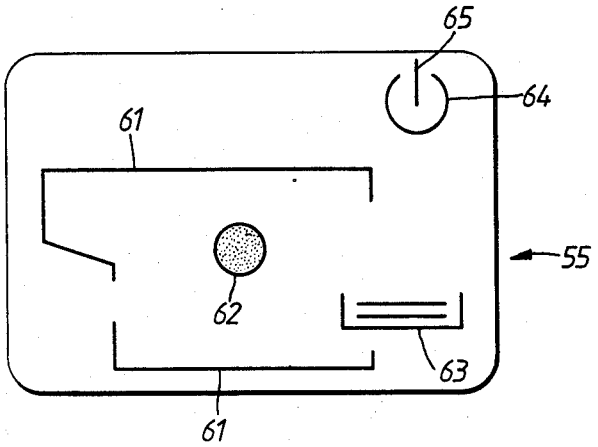
FIG. 4 is a plan view of a display panel of the copying machine.

As depicted in FIG. 4, the liquid crystal display panel of display part 55 is provided with a segment 61 for indicating the outline of casing 1, a segment 62 for indicating drum 11, a segment 63 for indicating cassettes 2 and 3, a segment 64 for indicating that the machine is ready for copying operation and a segment 65 for indicating that the machine is warming up.

FIG. 3 also shows that copying machine control part 51 and sorter control part 56 are connected to each other by means of signal lines, when sorter 30 is mounted on casing 1. These signal lines carry a sorter initialize signal S-INIT, an interrupt copy signal INTRPT, a bin initialize signal B-CLR, a copy run signal C-RUN, a jamming release signal J-CLR, a paper exit signal EXIT, and a final copy signal C-END, all output from copying machine controller 51 and input into sorter controller 56.

The S-INT signal reaches a high level when the power supply of the machine is turned on, when the machine is in the energy saving mode, or when the machine operation is initialized according to time-out of a timer. Thus, displays 55 and 60 are extinguished, and motors 58 and 59 are stopped by sorter control part 56 in response to the S-INIT signal. Machine conditions of sorter 30 and the position of bin station 35 are initialized by sorter controller 56 when the S-INIT signal changes from the high level to a low level.

The INTRPT signal reaches a high level when the machine is in the interrupt copying mode. According to the INTRPT signal, sorter controller 56 causes bins 35*a*–35*j* to position themselves so that copy sheets reproduced in the interrupt copying mode are stored in the uppermost bin after copy sheets reproduced in the previous mode are stored in bins 35*a*–35*j*. Bin station 35 is returned to the position to allow restarting of copying operation in the previous copying mode when the INTRPT signal changes from the high level to a low level.

The B-CLR signal reaches a high level for a predetermined time period after the set copy quantity is changed or cleared. In the sort mode, sorter controller 56 actuates bin station 35 to move to the initial position according to the B-CLR signal.

The C-RUN signal becomes high during copying operation. Responding to the C-RUN signal, sorter controller 56 does not change the operation mode of sorter 30 even if more switch 57 outputs signals for changing the operation mode.

The J-CLR signal reaches a high level when the door of the machine is opened and switch 29 is operated to detect the opened door. Thus, a jamming status of sorter 30 is released and motors 58 and 59 are stopped in response to the J-CLR signal.

The EXIT signal reaches a high level while copy sheet P passes switch 28.

The C-END signal reaches a high level when one copy run is performed and the last copy sheet of the copy run is discharged by discharging rollers 23. Responding to the C-END signal, control part 56 causes the number of sorting to be stored and bins 35*a*–35*j* to move opposite to the direction they move in the sort mode. In the group mode, however, control part 56 causes bins 35*a*–35*j* to move one-by-one according to the C-END signal.

A sorter operation signal S-BUSY, a sorter jam signal S-JAM, sorter mode signals S-MODE0 and S-MODE1, a copy sheet store signal C-RCV, and a sorter connection signal S-AVAIL are also output from controller 56 and input into controller 51.

The S-BUSY signal reaches a high level when switch 57 is operated for changing the operation mode of sorter 30, when the power supply of sorter 30 is turned off, or when the copying machine enters the interrupt copying mode. Responding to the S-BUSY signal, control part 51 controls to interrupt the copy run and to light display segments 64 and 65 so that restarting of copying operation is prohibited.

The S-JAM signal reaches a high level when sorter 30 has jammed and sorter 30 falls in the jam status. Responding to the S-JAM signal, controller 51 controls to interrupt the copying operation of the machine and to inhibit restarting of the operation until the S-JAM signal is turned to a low level.

The S-MODE0 and S-MODE1 signals are used together with the S-INIT signal for detecting the operation condition of sorter 30 and the allowable number of bins as shown in the following Table 1.

TABLE I

| The level of S-INIT | The signifigance of signals | S-MODE1 | S-MODE0 | Designation |
|---|---|---|---|---|
| L | The operation mode of sorter | L | L | Group mode |
| | | L | H | Sort mode |
| | | H | L | Non-sort mode |
| | | H | H | (Not defined) |
| H | The allowable number of bins | L | L | 20 bins |
| | | L | H | 10 bins |
| | | H | L | 15 bins |
| | | H | H | Others |

L: Low Level
H: High Level

The C-RCV signal reaches a high level for a predetermined time period after the trailing edge of copy sheet P is stored in bins 35*a*–35*j*. By this signal, controller 51 may detect the quantity of copy sheets P stored in sorter 30 and correct the copy quantity when sorter 30 falls into the jam status.

The S-AVAIL is used for determining that sorter 30 has been connected to the copying machine main body, so that controller 51 controls the machine using a control program including a sorter operation sequence.

Figure 5:
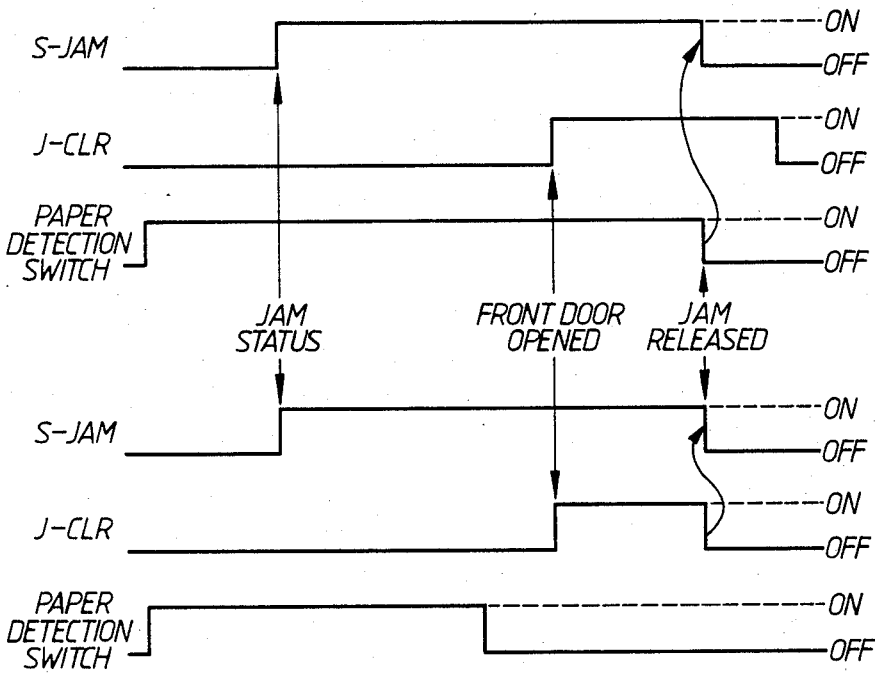
FIG. 5 is a timing chart for explaining the operation of the control device shown in FIG. 3.
Figure 6A:
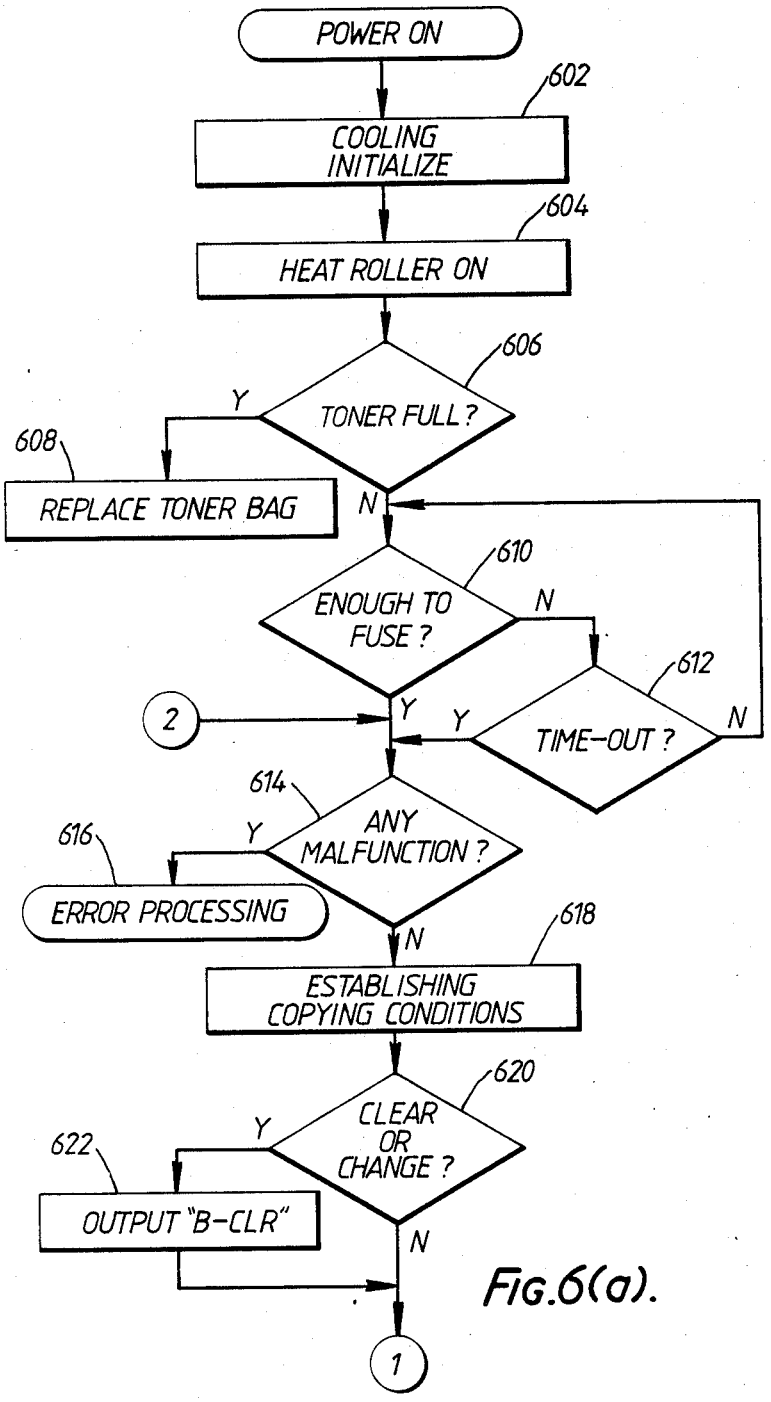
FIGS. 6(*a*), 6(*b*), 6(*c*) and 6(*d*) are flowcharts for explaining the control sequence of the control device.
Figure 6B:
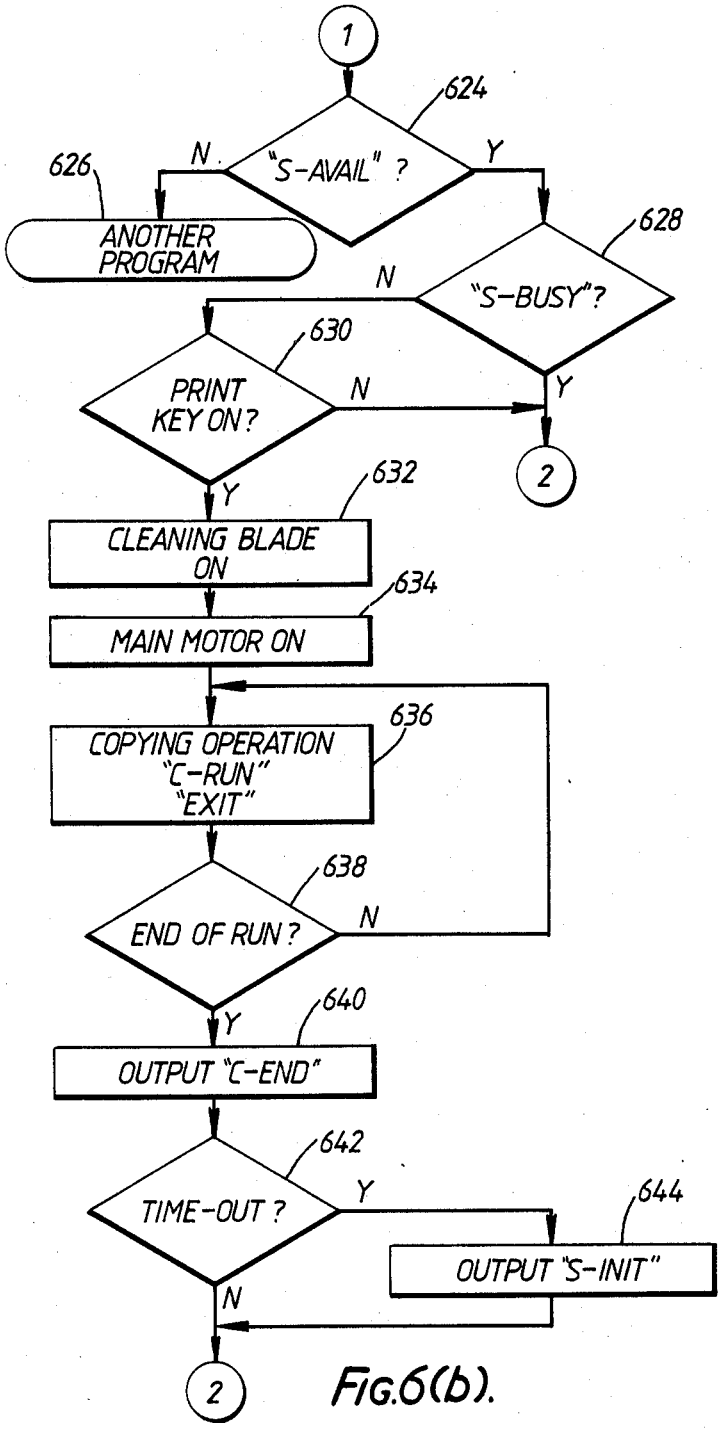
Figure 6C:
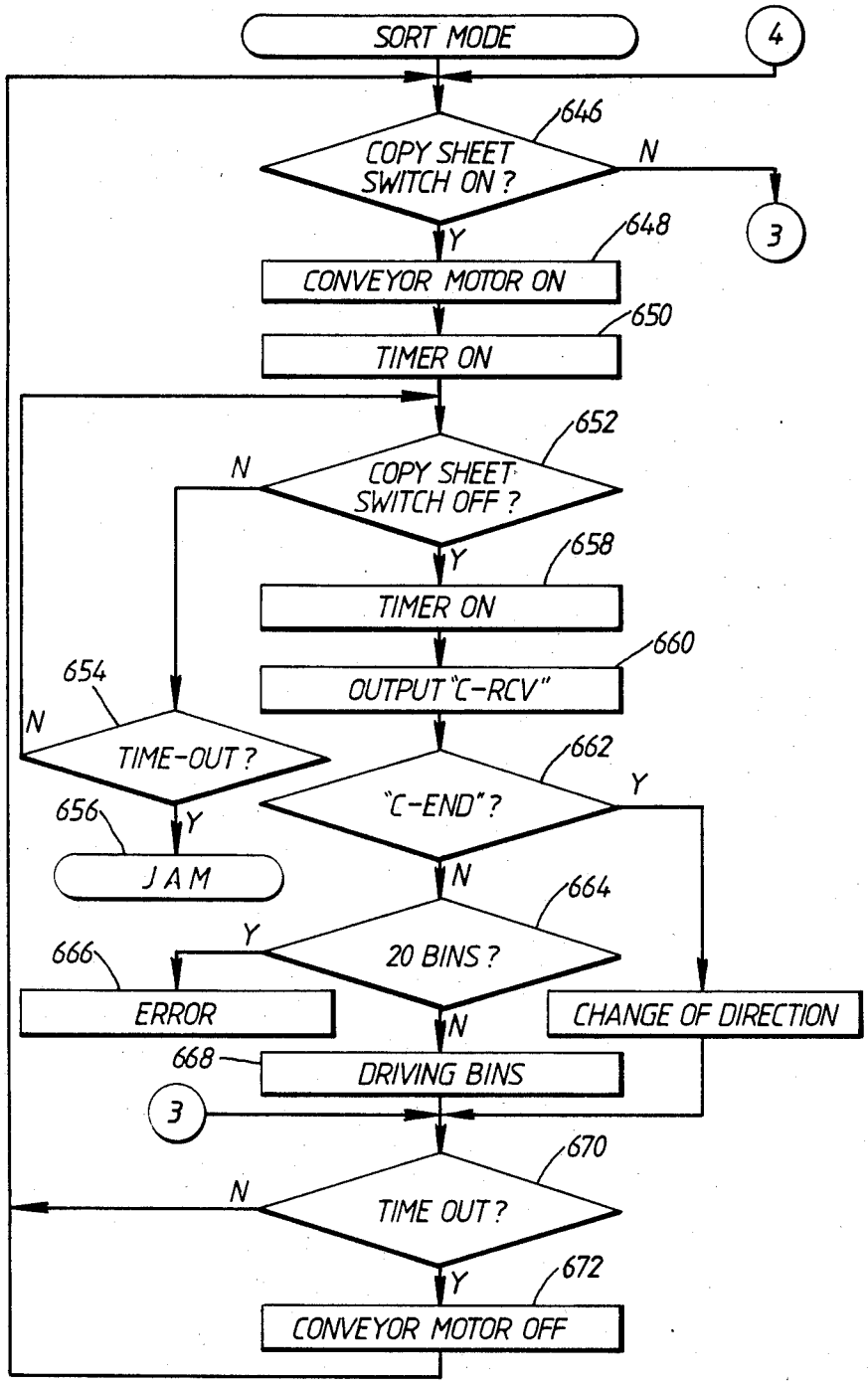
Figure 6D:
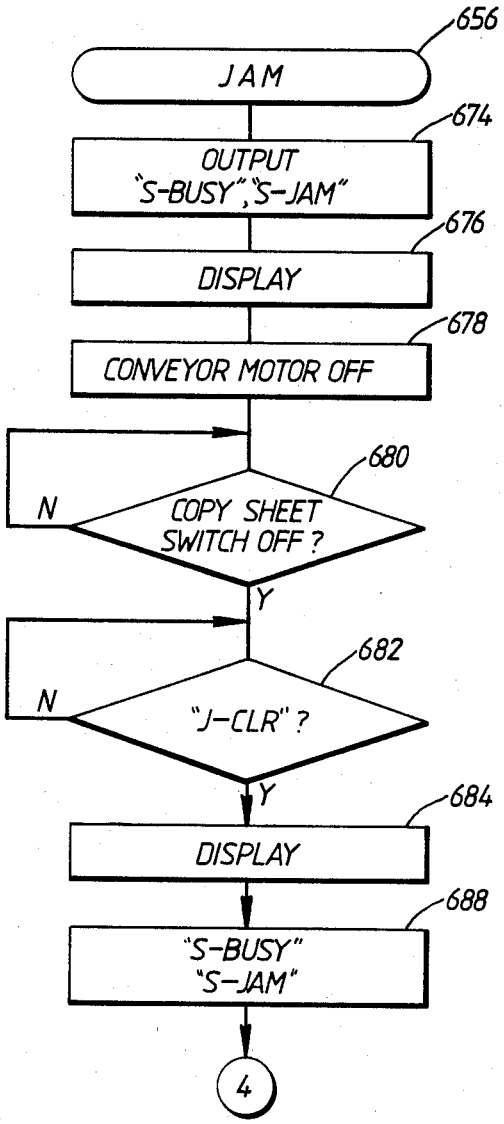

Now referring to the timing charts shown in FIG. 5, explanation regarding a jam status and a jam-clear operation will be given.

When sorter controller or control part 56 detects jamming in sorter 30 by the signal from paper detection switch 34, controller 56 stops motors 58 and 59 and sets sorter 30 in a jam status, so that the jam status is indicated by display 60 and the S-JAM signal reaches the high level. Responding to the S-JAM signal, controller 51 interrupts the copy run and inhibits restarting of the copying operation. When switch 29 detects the opening of the front door and the copy paper jammed at paper detection switch 34 is removed, the signal S-JAM is returned to the low level and thus the jam status is released. The upper half of FIG. 5 shows that jam status is not released merely by opening the front door of the copying machine. The bottom half of FIG. 5 shows that jam status is not released merely by removing the sheet of copy paper stuck at switch 34.

Thus, the system of the invention ensures that before jam status is cleared, the operator must both (1) clear the copy sheet which holds switch 34 in its on position and (2) open the front of the copy machine. Once the operator has opened the front of the copying machine, it is presumed that he or she has inspected the interior workings for a jammed paper sheet and removed any which are found.

Next, an explanation will be given regarding operation. In the embodiment discussed below, sorter 30 instead of tray 5 is mounted on casing 1. Therefore, sorter controller 56 and copying machine controller 51 are also electrically connected, and the S-AVAIL signal is supplied to controller 51.

Referring to FIGS. 6(*a*) and 6(*b*), in step 602 a cooling fan is operated and controller 51 controls to initialize copying conditions and machine status when the power supply switch is closed. Next, fuser 22 is charged and heat rollers are heated in step 604. Controller 51 then checks if a toner bag of recovered toner is full in step 606. If the toner bag is full, a display is provided in step 608. If not, controller 51 checks if the temperature of fuser 22 is fixable in step 610. If the temperature of fuser 22 is not fixable, controller 51 checks if a predetermined time period has elapsed in step 612. When the temperature of fuser 22 is fixable, it is judged that the machine is ready for initiating copying operations and executing the next step. When the temperature is not fixable and the predetermined time period does not elapse, the judgment is repeated in step 610.

In step 614, a malfunction including trouble in the controlling device is checked. If a malfunction is observed, a program for error pocessing is executed in step 616. If not, copying conditions for copy quantity, copy sheet selection, exposure modes and copy magnification are established by operating keys in step 618. When establishing copy quantity, controller 51 checks if the set quantity is less than or equal to the allowable number of bins according to the S-MODE0 and S-MODE1 signals. After step 618, the B-CLR signal is supplied to controller 56 in step 622 once the set quantity is cleared or changed in step 620.

Referring now to FIG. 6(*b*), next, controller 51 checks in step 624 if the S-AVAIL signal is input. If the S-AVAIL signal is low level, a sequence control program not including the operation of sorter 30 will be executed in step 626. If the S-AVAIL signal is high, controller 51 checks if the S-BUSY signal is input in step 628. If the S-BUSY signal is low level, copying operation may be started in step 630 in response to print switch 52. If not, control returns to step 614 shown in FIG. 6(*a*). If the print key is depressed in step 630, the cleaning blade of cleaner 24 is pressed against drum 11 in step 632, the main motor of the machine starts operation in step 634 and copying operation commences in step 636. Drum 11 is previously charged by charger 14, and electrostatic latent images are formed on the surface of drum 11 as the optical system scans the original on platen 6. These latent images are developed by developing device 15. On the other hand, copy sheet P is fed from the selected cassettes 2 and 3 or table 4 by feed rollers 16, 26 and 27. Copy sheet P is transported to transferring station 18 by register rollers 17. Thus, the developed image on the surface of drum 11 is transferred on copy sheet P by charger 19. Then, copy sheet P carrying the transferred image is separated from drum 11 by charger 20, and is transported into fuser 22. The sheet with the transferred image is heated and pressed by fixing device 22, so that the transferred image is fixed on copy sheet P. Sheet P is then sent into sorter 30 by discharge rollers 23. After the transferring operation, the residual toner and residual charge on the surface of drum 11 are removed by cleaner 24 and erase lamp 25, so that drum 11 is ready for forming images repeatedly.

In this copying operation step, the C-RUN and EXIT signals are supplied to sorter 30. In response to the C-RUN and EXIT signals, controller 56 detects that the copying machine is carrying out copying operations and that copy sheet P is discharged, respectively.

Then, in step 638, controller 51 checks if the copy run is performed. When the copy run is finished, the C-END signal is output in step 640. On the contrary, if the copy run has not been finished, the copy operation to be performed is executed repeatedly. Responding to the C-END signal, controller 56 detects that one copy run has been completed. In step 642, a determination is made whether a predetermined period has elapsed since the execution of the previous copy run. If it has elapsed, the S-INIT signal is output in step 644. Responding to the S-INIT signal, the position of bin station 35 is initialized. If the predetermined time period has not elapsed, the machine is left in a standby status.

A timer for checking time-out is provided within controller 51. The net effect of the control is that if the machine is not operated for a predetermined time period, the time period is counted down by the timer, so that the machine returns to an initialized status. In this condition, the machine is in a priority mode in which most copying runs are executed. Then, operation step returns to the routine shown in FIG. 6(*a*).

Referring to FIGS. 6(*c*) and 6(*d*), the operation of sorter 30 is explained. When the power supply switch of sorter 30 is closed, controller 56 checks if the S-INIT signal reaches a high level. If the signal is high level, sorter 30 enters an initialized status. If not, the operation mode of sorter 30 may be selected by operating mode switch 57. Control part 56 actuates motor 59 to rotate cam 38, so that bins 35*a*–35*j* are moved downward. This movement causes actuation of switch 41. Controller 56 then stops motor 59 according to signals from switch 41. Thus bin station 35 is established at its initial position.

On the other hand, controller 56 supplies the S-MODE signals to controller 51.

Then, the operator operates print switch 52 to start a copy run. Sheet P is then transported into sorter 30 through passage 32. When the leading edge of copy sheet P reaches paper detection switch 34, switch 34 supplies a signal to controller 56. In step 646, controller 56 detects the signal, and, in step 648, energizes motor 58 to rotate transportation roller 33, in response to the signal. Simultaneously, in step 650 controller 56 activates a timer for detecting a sorter jam. This jam detecting timer is a retriggerable down counter which may be actuated by the rising pulse of the signal output from switch 34, and utputs a timed-out signal after a predetermined time period elapses. Then, in step 652 controller 56 checks if switch 34 is operated by the copy sheet. If switch 34 is operated by the copy sheet, controller 56 in step 654 checks if the jam detecting timer has timed-out. If the timer has timed-out, a jam recovering program will be executed in step 656. If not, the judgment of the operation of switch 34 is repeated in step 652. If switch 34 is released from operation, in step 658 controller 56 activates a timer for controlling the rotation of motor 58. This controlling timer is a retriggerable down counter which may be activated by the descending pulse of the signal output from switch 34, and outputs a timed-out signal after a predetermined time period elapses. Then, in step 660, controller 56 outputs the C-RCV signal for indicating that copy sheet P is loaded on bins 35*a*–35*j*. Next, in step 662 controller 56 checks if the C-END signal is supplied to sorter 30. If the C-END signal is output, controller 56 actuates motor 59 to move bin station 35 upwardly in step 664. If not, controller 56 checks in step 664 if bin 35*j* is positioned for receiving copy paper P. If bin 56*j* is located to receive copy paper P, an error routine will be entered in step 666 because the set copy quantity exceeds the allowable number of sorting. If not, controller 56 actuates motor 59 to move bins 35*a*–35*j* one-by-one in step 668.

After that, controller 56 checks if the controlling timer has timed-out in step 670. If the timer has timed-out, the conveyor motor is turned off in step 672 and control returns to step 646. If not, control simply returns to step 646.

In the jam recovering program of step 656, controller 56 outputs the S-BUSY and S-JAM signals in step 674 as shown in FIG. 6(*c*). By these signals, controller 51 detects that a jamming in sorter 30 has occurred. Controller 56 also energizes display 60 which indicates the occurrence of the sorter jamming in step 676. Then, in step 678 controller 56 stops motor 58 to interrupt the transportation of copy sheets. In step 680, controller 56 checks if switch 34 is pressed by the copy sheet which has caused occurrence of the sorter jamming. If switch 34 is still pressed, the above-mentioned judgment is repeated. If not, controller 56 checks if controller 51 outputs the J-CLR signal in step 682. If the J-CLR signal is supplied to controller 56, controller 56 extinguishes display 60 in step 684 and outputs the S-BUSY and S-JAM signals in step 688. Then, the control step returns to step 646 as shown in FIG. 6(*c*). If the existence of the J-CLR signals is not observed, the judgment will be repeated.

If the non-sort mode is selected, sheets P successively transported are loaded one-by-one on bin 35*a* by repetition of the above-mentioned operation. In the group mode, controller 56 energizes motor 59 to rotate cam 38 responsive to the C-END signal, so that copies of each group according to different originals are stored in a different bin.

Moreover, a jamming occurring in the copying machine is detected by discharge detecting switch 28. That is, when the copy run is started, feed roller 16 or 26 is actuated and copying machine control part 51 operates a built-in timer. After a predetermined time elapses, controller 51 reads in a signal from switch 28. When the copied sheet is discharged outside the copying machine without jamming, switch 28 is pressed by the copied sheet at the time when the timer has timed-out. Therefore, if jamming has occurred in the copying machine, switch 28 is not pressed when the timer has timed-out.

In the above embodiment, the present invention is applied to a photocopying machine, but may also be applied to a printer or a facsimile machine.

Obviously, numerous modifications and variations of the present invention are possible in light of the above teachings. It is, therefore, to be understood that within the scope of the appended claims, the invention may be practiced other than as specifically described herein.

What is claimed is:

1. An image forming apparatus comprising:

means for forming an image on a copy sheet;

means for delivering the copy sheet carrying the image formed by said image forming means;

means for collating the copy sheet delivered by said delivering means;

means for covering said delivering means, said covering means being adapted to be openable so as to permit access to said delivering means to remove the copy sheet;

first detecting means for detecting the opening of said covering means;

second detecting means for detecting a jamming of the copy sheet in said collating means;

first control means for stopping the image forming operation of said image forming means in response to the detection of said second detecting means; and second control means for permitting the restarting of the image forming operation in response to the detection of the opening of said covering means by said first detecting means only if said second detecting means detects that the jamming of the copy sheet in said collating means has been cleared.

2. An image forming apparatus according to claim 1, wherein said collating means includes a plurality of bins to be loaded by successive copy sheets and a transportation roller for transporting the copy sheet delivered by said delivering means into one of said plurality of bins, and wherein said second detecting means includes a switch adapted to activate said transportation roller when said switch has been actuated by one of said successive copy sheets.

3. An image forming apparatus according to claim 2, wherein said second detecting means detects the jamming of the copy sheet in response to the actuation of said switch at a predetermined time.

4. An image forming apparatus according to claim 1, further comprising:

first signal output means for generating a jam signal in response to the detection of said second detecting means;

second signal output means for generating a release signal in response to the detection of said first detecting means; and means for interrupting the generation of the jam signal in response to the release of the jamming and the release signal generated by said second signal output means.

5. An image forming apparatus comprising:

means for forming an image on a copy sheet;

means for discharging the copy sheet carrying the image formed by said image forming means;

means for detecting the copy sheet discharged by said discharging means;

means for transporting the copy sheet, said transporting means being operative in response to the detecting operation of said detecting means;

means for receiving the copy sheet transported by said transporting means;

means for outputting a jam signal in response to the detecting operation of said detecting means at a predetermined time;

means for interrupting the image forming operation of said image forming means in response to the jam signal output from said jam signal outputting means;

means for covering said discharging means, said covering means being adapted to open so as to permit access to said discharging means;

means for outputting a release signal in response to the opening of said covering means only if the jam signal output from said jam signal outputting means has been cleared; and means for restarting the image forming operation of said image forming means in response to the release signal output from said release signal outputting means.

6. An image forming apparatus according to claim 5, further comprising:

means for detecting a jamming in said image forming means; and means for interrupting the image forming operation of said image forming means in response to the detection of said jamming detecting means.

7. A method of coordinating operation of an image forming apparatus and sorter comprising the steps of:

(a) determining whether a copy sheet discharged from said image forming apparatus has jammed in said sorter;

(b) causing said image forming apparatus and said sorter to enter a jam status in response to a positive determination in said step (a);

(c) in response to entering said jam status, determining whether said jammed copy sheet has been cleared;

(d) in response to entering said jam status, determining whether a door on said image forming apparatus has been opened; and (e) causing said image forming apparatus and said sorter to restart the image forming operation if both said determination in said step (c) and said determination in said step (d) are positive, and otherwise repeating said step (c) if said determination in said (c) is negative, and repeating said step (d) if said determination in said step (d) is negative, until both said determinations are positive, and then causing said image forming apparatus and said sorter to restart the image forming operation.

* * * * *